US007342172B1

(12) United States Patent
Wang et al.

(10) Patent No.: US 7,342,172 B1
(45) Date of Patent: Mar. 11, 2008

(54) CABLE WITH NOISE SUPPRESSION

(75) Inventors: Shu-Li Wang, Santa Clara, CA (US); R. Sean Murphy, Sunnyvale, CA (US); Robert J. Steinfeld, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 11/649,656

(22) Filed: Jan. 3, 2007

(51) Int. Cl.
*H01B 11/06* (2006.01)

(52) U.S. Cl. ..... 174/36

(58) Field of Classification Search ..... 174/36, 174/113 R, 106 R
See application file for complete search history.

(56) References Cited

U.S. PATENT DOCUMENTS 5,719,353 A 2/1998 Carlson et al.
5,990,417 A * 11/1999 Senda et al. ..... 174/391
6,252,163 B1 * 6/2001 Fujimori et al. ..... 174/36
6,388,188 B1 5/2002 Harrison
6,448,500 B1 * 9/2002 Hosaka et al. ..... 174/113 R
6,479,753 B2 11/2002 Borg et al.
6,534,708 B2 3/2003 Ono et al.
6,812,408 B2 11/2004 Clark et al.
6,815,611 B1 11/2004 Gareis
6,921,573 B2 7/2005 Watanabe et al.
7,135,641 B2 11/2006 Clark
2003/0051897 A1 * 3/2003 Blouin et al. ..... 174/106 R
2004/0055772 A1 * 3/2004 Tsutsui et al. ..... 174/36

OTHER PUBLICATIONS

"Noise Suppression sheet", vol. 09, Mar. 14, 2006, by product data sheet of NEC/TOKIN.
"Selecting and Using EMI Components and Materials" [online]. by the editors of Conformity [retrieved on Jan. 3, 2007]: <URL: http://www.conformity.com/0506/0506selecting.html>.

* cited by examiner

*Primary Examiner*—Chau N. Nguyen
(74) *Attorney, Agent, or Firm*—G. Victor Treyz

(57) ABSTRACT

A cable may be provided having a noise-suppression ferrite loaded magnetic tape wrapped in a spiral. The cable may have a strengthening cord at its core. Signal wires such as data wires and power wires may surround the strengthening cord. The signal wires may have copper cores that are coated with polytetrafluoroethylene insulating coatings. A metallized polyester tape may be wrapped around the signal wires to reduce electromagnetic interference. A braided copper shield may be formed over the metallized polyester tape. The magnetic tape may be wrapped around the metal braid. One or both edges of the magnetic tape may have uncovered areas in which no magnetic material is present. The cable may have connectors its ends. The magnetic tape wrap may extend from one connector to the other.

19 Claims, 6 Drawing Sheets

CABLE WITH NOISE SUPPRESSION

BACKGROUND

This invention relates generally to cables, and more particularly, to high-frequency cables with noise suppression features.

Cables are used to interconnect pieces of electronic equipment. For example, cables that are compliant with the Digital Video Interface (DVI) standard are used to interconnect personal computers and computer monitors. Universal serial bus (USB) cables are commonly used to interconnect personal computers with peripherals such as music players, digital cameras, and printers.

Cables that carry high frequency signals may emit undesirable radio-frequency electromagnetic radiation and may be subject to radio-frequency noise from external sources. This is particularly the case in cables that do not use expensive high-quality coaxial termination arrangements. To minimize the impact of external radio-frequency noise sources and to reduce radio-frequency emissions, high-frequency cables are commonly shielded using conductive shielding such as braided copper, spiral windings of copper tape, spiral windings of thin copper wire, and metallized polymer. The conductive shielding serves to prevent external signals from coupling onto the signal wires in the cable and minimizes radio-frequency emissions from the cable that could adversely affect nearby electrical equipment.

Particularly when very high frequencies are involved (e.g., signals in the upper megahertz and lower gigahertz range), the use of conductive cable shielding is unable to eliminate all adverse radio-frequency effects. In typical arrangements, the conductive shield of a cable is shorted to the ground of the electrical equipment to which it is connected. If the electrical equipment that is attached to cable exhibits ground noise, the ground noise can be coupled onto the conductive shielding of the cable. Unless corrective measures are taken, the coupled ground noise can cause the conductive shielding to emit undesirable radio-frequency electromagnetic radiation.

Ferrite loaded magnetic cable noise suppressors have been developed to address these problems. Magnetic cable noise suppressors are commonly based on toroidal ferrite beads or tubular ferrite profiles. With this type of arrangement, a cable noise suppressor is placed at the end of a cable where it surrounds the signal wires in the cable. The noise suppressor attenuates radio-frequency noise by creating a large impedance at high electromagnetic frequencies.

Ferrite beads tend to be unsightly, so less intrusive noise suppression arrangements have been developed that are based on sheets of high-permeability magnetic material. Such arrangements have not been widely used in practice due to issues with manufacturability, cost, and complexity.

It would therefore be desirable to provide improved cables with noise suppression capabilities.

SUMMARY

In accordance with the present invention, a cable may be provided for conveying data and power signals between electronic devices. The cable may have connectors on either end. With one suitable arrangement, one end of the cable may be provided with a universal serial bus (USB) connector and the other end of the cable may be provided with a 30-pin connector. Other type of connectors may be used, if desired.

The cable may contain one or more cords that do not carry electrical signals. For example, the cable may include a strengthening cord for providing the cable with increased mechanical strength. The cord may be located in the center of the cable (i.e., along the cable's longitudinal axis).

Power and data wires may be provided adjacent to and surrounding the strengthening cord. Any suitable number of power and data wires may be used. For example, there may be one, two, three, four, or more than four data wires. The power wires typically include a positive power wire and a power return conductor (sometimes referred to as ground). If desired, different numbers of power wires may be used.

The data wires may include one or more twisted pairs of wires to reduce noise. With one suitable arrangement, the cable may use a wiring scheme that is compatible with the universal serial bus (USB) standard. In this type of situation, the cable may include a twisted pair of wires, sometimes referred to as D+ and D− wires, a positive power supply wire, and a ground power supply wire.

The data and power wires may be insulated with an insulation that is able to withstand high voltages without being formed in thick coating layers. For example, the data and power wires may be insulated using polytetrafluoroethylene (e.g., Teflon®). This type of insulating arrangement may allow the insulated wires to have a smaller outer diameter than would otherwise be possible, thereby avoiding unnecessary cable stiffness and allowing the cable to bend more readily. If desired, other types of insulating may be used on the signal wires in the cable (e.g., polyvinylchloride, etc.).

Multiple layers of conductive shielding may be provided. For example, a spiral wrap of conductive film may be used to form an inner conductive layer. The conductive film may be provided in the form of a metallized tape such as an aluminized tape. With one suitable arrangement, the conductive film may be formed from a plastic tape that is formed from a polyester film such as a biaxially-oriented polyethylene terephthalate polyester film (e.g., Mylar®). Aluminized polyester film has good mechanical properties and its thin layer of deposited aluminum helps to reduce electromagnetic interference for the cable.

Electromagnetic interference may also be suppressed by providing a braided conductor around the metallized plastic film wrap. The braided conductor may, for example, be provided in the form of a copper braid exhibiting a desired amount of braid coverage. With one suitable arrangement, the cable has 90% or more braid coverage. As the cable bends, small gaps may open up in the copper braid. However, the presence of the aluminize polyester film helps to reduce electromagnetic radiation leakage through the gaps. At the same time, the copper braid may compensate for gaps that may develop in the aluminize polyester.

The cable may use a noise-suppressing wrap of magnetic material to further reduce electromagnetic interference by creating a high impedance for radio-frequency noise. With one suitable arrangement, the magnetic material may be a ferrite loaded magnetic material. The wrap may be formed from a magnetic material tape having a thin layer of high-permeability magnetic material on a thin backing layer. Use of a thin magnetic material layer and thin backing help to avoid stiffening the cable. The backing layer may be formed from polyester film such as a biaxially-oriented polyethylene terephthalate polyester film (e.g., Mylar®).

When wrapping the tape of high-permeability magnetic material around the cable, the tape may overlap itself by about 25% to ensure uniform gap-free coverage. A wrap angle of about 10-20° may be used. The high-permeability magnetic material may be provided in the form of a strip having the same width as the backing layer or may be provided in the form of a strip having a different width than the backing layer. When using a magnetic-material strip that is smaller in width than its associated backing strip, one region or two regions of backing layer tape that are uncoated by magnetic material may be created. The uncoated backing layer regions may improve adhesion of the high-permeability magnetic material tape when wrapping the tape around the core of the cable. This may help to prevent the tape from sliding along itself within the cable when the cable is bent. The wrapped high-permeability magnetic tape and the rest of the inner cable structure may be coated with an insulating plastic overmold or other suitable outer coating.

Further features of the invention, its nature and various advantages will be more apparent from the accompanying drawings and the following detailed description of the preferred embodiments.

DETAILED DESCRIPTION

Figure 1:
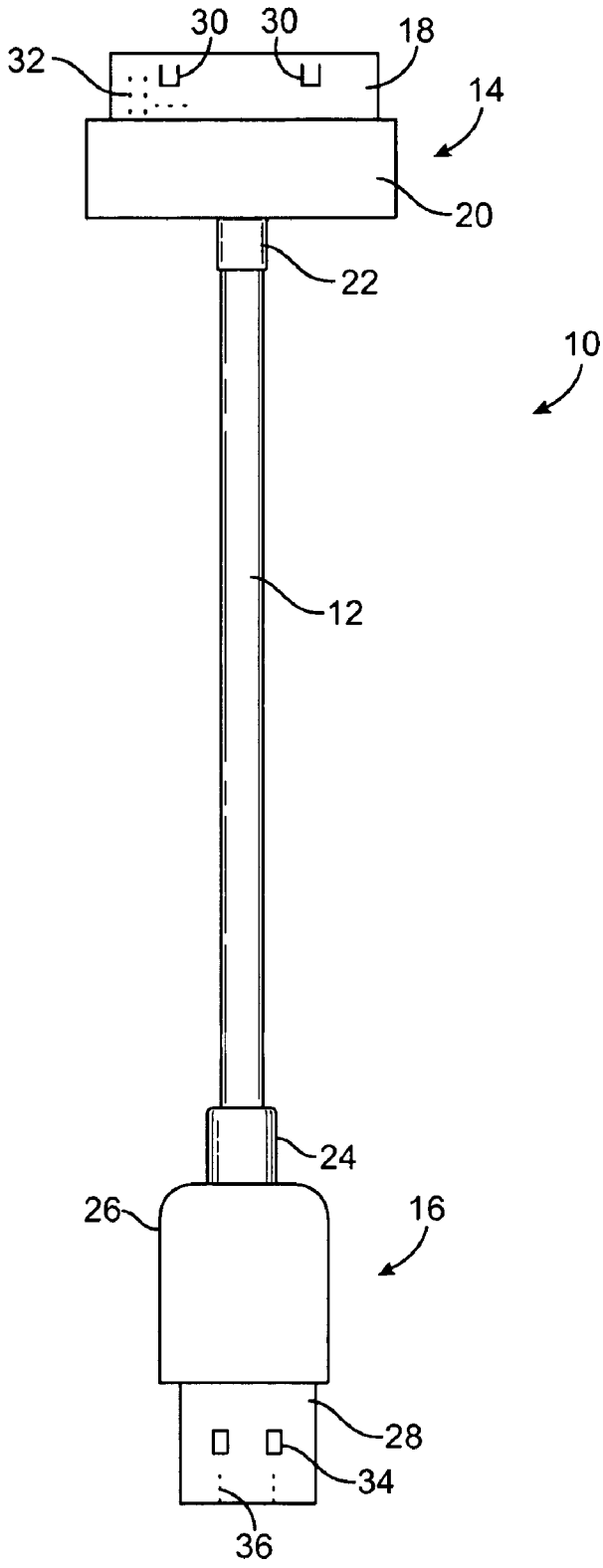
FIG. 1 is a top view of an illustrative cable with two illustrative cable connectors in accordance with an embodiment of the present invention.

An illustrative cable in accordance with an embodiment of the present invention is shown in FIG. 1. Cable 10 may have connectors such as connectors 14 and 16 and a cable portion such as cable 12. Cable 12 may include any suitable conductive wires. Typically cable 12 includes data wires and power wires. If desired, additional components (e.g., optical fiber) may be included in cable 12.

Connectors 14 and 16 may be formed using any suitable connector arrangements. With one suitable scheme, connectors 14 and 16 are of different types. For example, as shown in FIG. 1, cable connector 16 may be a universal serial bus (USB) connector and cable connector 14 may be a 30-pin cable connector. This is, however, merely illustrative. Connectors 14 and 16 may be the same (e.g., both may be USB connectors or both may be 30-pin connectors, etc.) or connectors 14 and 16 may be different.

Connectors 14 and 16 may plug into any suitable electronic equipment. For example, connector 16 may plug into a universal serial bus port on a personal computer and connector 14 may plug into a data port on a handheld electronic device that has music player and cellular telephone capabilities.

Connector 14 may have a main body 20 that has a plastic overmold. Connector 16 may have a main body 26 with a plastic overmold. Main body 20 of connector 14 and main body 26 of connector 16 may be formed from any suitable plastic or other dielectric. With one suitable arrangement, body 20 and body 26 are formed of polycarbonate. Strain relief elements 22 and 24, which may be formed from flexible plastic, may be used to help physically secure cable 12 to connectors 14 and 16. In a typical connector, metal pins or other suitable electrical contacts (herein collectively "pins") are used to convey signals from the wires within the cable to external equipment. In the example of FIG. 1, connector 14 is shown as having one or more pins 32 and connector 16 is shown as having one or more pins 36.

The number of pins within each connector should generally be equal to or greater than the number of conductive wires within cable 12. For example, if there are two power wires and two signal wires within cable 12, there should generally be at least four pins 36 and four pins 32 in connectors 16 and 14, respectively. If the number of pins on the connectors is insufficient, some wires may be terminated on common pins or some wires may be left unconnected.

If desired, there may be more pins on a particular connector than there are within cable 12. For example, there may be 30 pins 32 within connector 14, even in embodiments of cable 12 that use only four wires (as an example).

Plug portion 28 of connector 16 may have holes 34 that receive corresponding protruding portions on a mating female connector. This arrangement provides friction that helps to hold plug portion 28 to the female connector. Protruding portions 30 on metal plug portion 18 may be used to help secure metal plug portion 18 within a mating connector. Plug portions 28 and 18 may be shorted to ground.

Cable 10 may be used in connection with equipment that handles upper megahertz-range and lower gigahertz-range cellular telephone signals and other such high-frequency data signals. Particularly in environments such as these, it can be advantageous to ensure that cable 12 is well shielded. Failure to provide sufficient electromagnetic interference protection in cable 12 may cause high-frequency signals (including signal harmonics at frequencies equal to two times, three times, or even hundreds of times a base tone signal frequency) to be emitted by cable 12 into its surroundings. This emitted radiation may cause harmful interference with other equipment. Moreover, with insufficient electromagnetic interference protection, high-frequency signals from external sources may be coupled onto the cable and passed to equipment that is coupled to the cable.

To suppress electromagnetic interference of this type, cable 12 may be provided with both conductive electromagnetic shielding and high-permeability magnetic material shielding. Because suppression of electromagnetic interference reduces noise, the conductive electromagnetic shielding and high-permeability magnetic material shielding are sometimes referred to as noise suppressing shielding.

Figure 2:
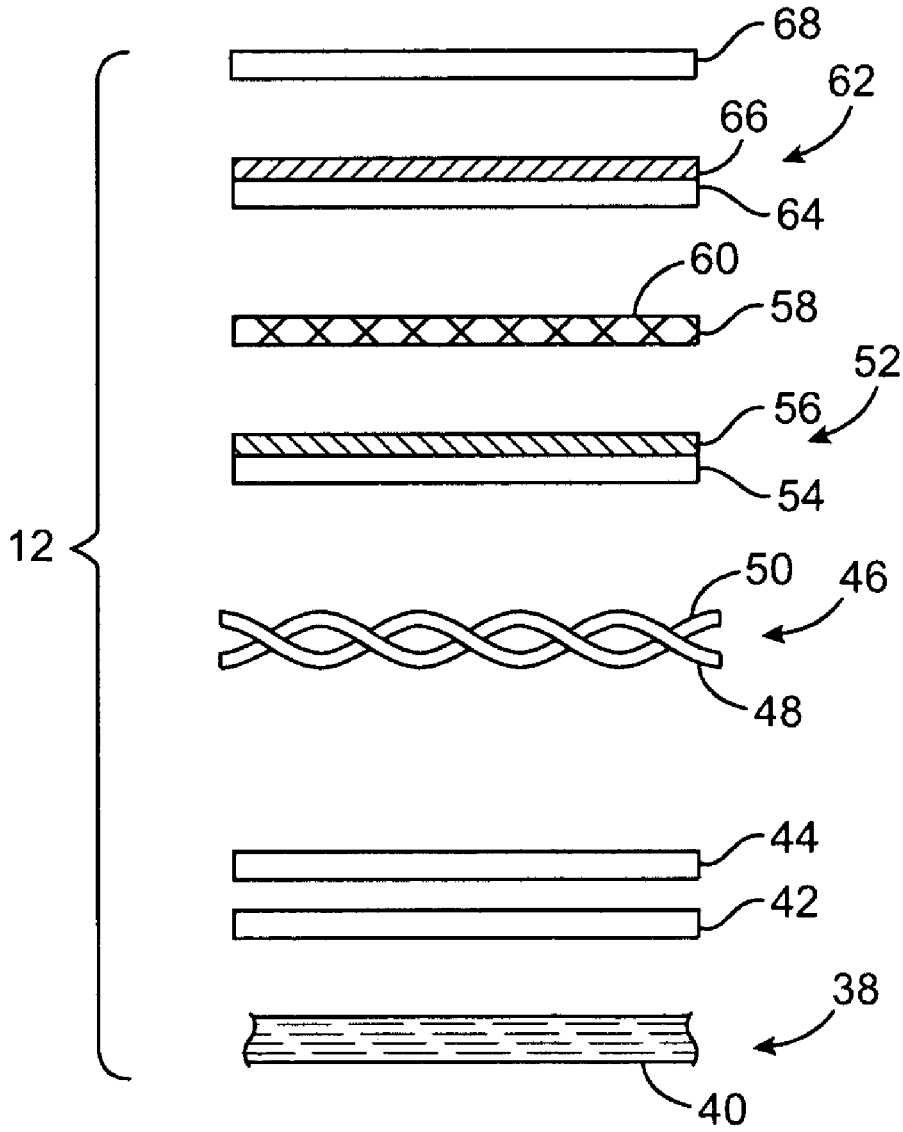
FIG. 2 is a schematic view of illustrative components of a cable in accordance with an embodiment of the present invention.

Components that may be used to construct an illustrative shielded cable in accordance with an embodiment of the present invention are shown in FIG. 2. As shown in FIG. 2, strength may be provided to cable 12 using a structural component such as cord 38. Cord 38 may be formed from any suitable material, although non-conductive materials are generally desired to avoid interfering with the electrical operation of the data wires in cable 12. With one advantageous arrangement, cord 38 is formed from a high-strength synthetic material such as polyaramid polyparaphenylene terephthalamide (e.g., Kevlar®). Cord 38 may be made up of individual filaments 40 and may have any suitable density (e.g., 1000 denier).

Power wires such as power wires 42 and 44 may be used to carry alternating current (AC) or direct current (DC) power signals. Power wire 42 may be a power supply and signal return wire (sometimes referred to as a ground wire) and power wire 44 may be a positive power supply wire. If desired, there may be more power wires in cable 12. Power wires such as wires 42 and 44 may have any suitable diameters. With one suitable arrangement, power wires 42 and 44 are formed of 26 gauge copper.

Signals wires 46 such as signal wire 48 and signal wire 50 may be used to carry data signals in cable 12. There may, in general, be any suitable number of signal wires in cable 12. With the illustrative embodiment of FIG. 2, cable 12 has two signal wires 48 and 50, which are provided in the form of a twisted pair to improve noise immunity. Signal wires such as wires 48 and 50 may have any suitable diameters. With one suitable arrangement, signal wires 48 and 50 are formed of 28 gauge copper. When signal wires 48 and 50 are formed of 28 gauge wire and power wires 42 and 44 are formed of 26 gauge wire, the diameters of the conductive cores of signal wires 48 and 50 are smaller than the diameters of the conductive cores of power wires 42 and 44. This type of arrangement allows the power wires to carry more current than the data wires and provides more room for extra insulation on the data wires to improve data signal integrity.

Signal wires 46 and power wires 42 and 44 may be surrounded by conductive shields such as shield 52 and shield 58. Shield 52 may be formed of from a spiral wrap of conductive film having conductive layer 56 and backing layer 54. The conductive film may be provided in the form of a metallized plastic strip such as aluminized tape. The plastic backing material for the tape may be formed from a polyester film such as a biaxially-oriented polyethylene terephthalate polyester film (e.g., Mylar®). The layer of deposited aluminum on the tape helps to reduce electromagnetic interference for cable 12. If desired, conductor 56 may be deposited on both sides of backing 54 or may be deposited on the inner surface of backing 54.

Electromagnetic interference may be further suppressed using shield 58. Shield 58 may be, for example, a braided conductor. The braided conductor of shield 58 may be formed of copper or other suitable conductors. The braided conductor may have any suitable amount of coverage (e.g., more than 80%, more than 85%, more than 90%, more than 95%, 85-95%, etc.). If the coverage of the braided conductor in shield 58 is too high, cable 12 may become stiff. With one suitable arrangement, the braided conductor in shield 58 is copper braid of approximately 90% coverage. Braided conductor shield 58 and metal film conductive shield 52 may work together to reduce electromagnetic interference under a variety of bending conditions for cable 12. An advantage of depositing metal 56 on the outer surface of conductive shield tape 62 is that this provides a low impedance conducting path to conductive braid wires 60 of shield 58.

When cable 12 is plugged into electrical equipment, shields 52 and 58 may be shorted to ground. Ground noise that is present on shielding conductors can radiate as undesired electromagnetic signals unless properly suppressed. Cable 12 therefore preferably has additional noise suppression features in the form of noise-suppression magnetic film 62. Magnetic film 62 may be provided in the form of a strip of magnetic material that is wrapped around shield 58 (i.e., a magnetic tape).

Magnetic film 62 may have backing layer 64 and may have one or more magnetic layers such as magnetic layer 66 on backing layer 64. Backing layer 64 may be formed from a thin structurally sound flexible material. As an example, backing layer 64 may be formed from a polyester film such as a biaxially-oriented polyethylene terephthalate polyester film (e.g., Mylar®). Magnetic film layer 66 may be formed from a ferrite material or other suitable high-permeability material. With one particularly suitable arrangement, magnetic layer 66 is formed from the high-permeability ferrite loaded magnetic material known as FLEX IMPEDOR®, which is available from NEC/TOKIN of Tokyo, Japan. This material operates at frequencies in the upper megahertz and lower gigahertz range. The thickness of magnetic layer 66 may be about 25 μm, about 50 μm or any other suitable thickness. Thin film thicknesses (e.g., thicknesses under about 100 micrometers) are generally desirable to avoid stiffening cable 12 unnecessarily.

Backing materials such as backing material 54 and backing material 64 may have any suitable thickness. With one suitable arrangement, the thicknesses of these backing films is about 0.01 mm to 0.02 mm. An advantage of using a polyester film of sufficient strength for backing materials 54 and 64 is that this ensures that the tapes used to form layers 52 and 62 will have sufficient tensile strength to endure wrapping operations during manufacturing.

Cable 12 may be housed within a plastic overmold formed of polyvinyl chloride plastic or other suitable insulating coating 68.

Figure 3:
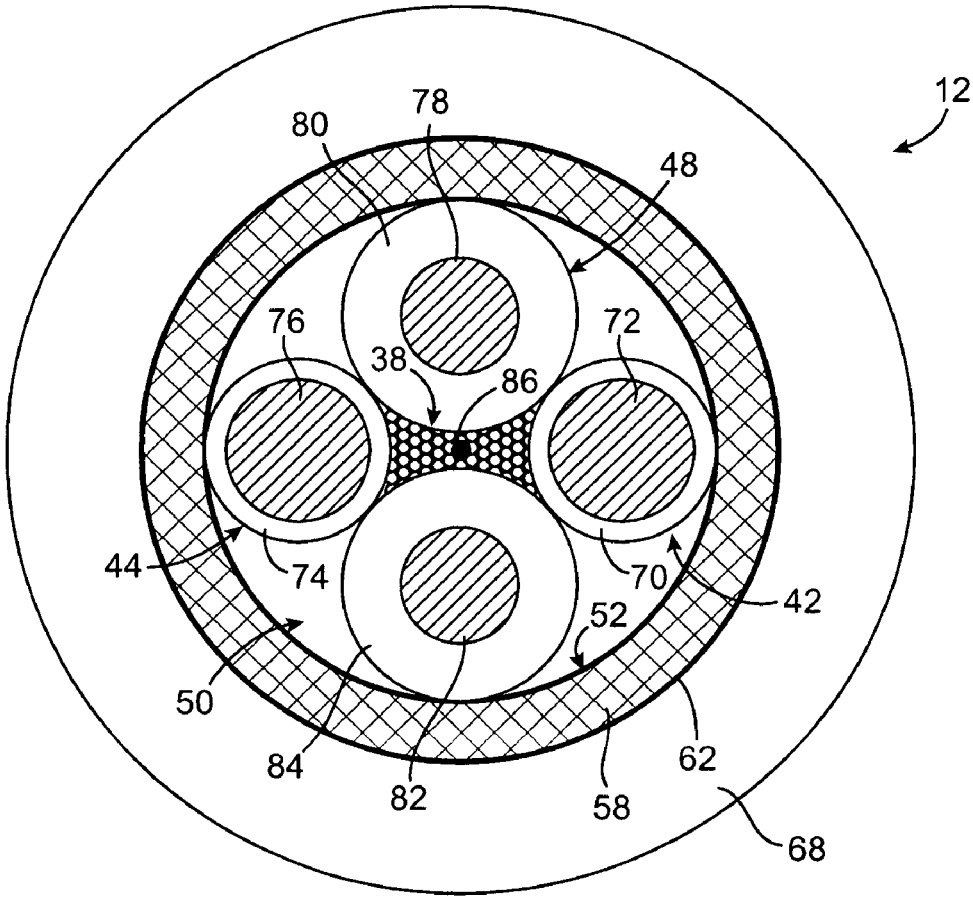
FIG. 3 is a cross-sectional end view of an illustrative cable in accordance with an embodiment of the present invention.

A cross-sectional view of an illustrative embodiment of cable 12 is shown in FIG. 3. Cable 12 has central longitudinal axis 86, which extends into and out of the page in FIG. 3. Strengthening cord 38 may be located in the center of cable 12 along longitudinal axis 86. If cable 12 is pulled along longitudinal axis 86, strengthening cord 38 will help to prevent breakage in the electrical wires within cable 12. Cord 38 may be anchored to connectors 14 and 16 to help prevent damage to the electrical connections between cable 12 and connectors 14 and 16.

Data wires 48 and 50 and may be formed from metal wire cores 78 and 82 (e.g., 28 gauge copper) surrounded by insulating coatings 80 and 84, respectively. Power wires 42 and 44 may be formed from metal wire cores 72 and 76 (e.g., 26 gauge copper) and insulating coatings 70 and 74, respectively. The insulating coatings may be formed from any suitable materials such as polyvinyl chloride or polytetrafluoroethylene (e.g., Teflon). An advantage of using polytetrafluoroethylene for insulating coatings such as coatings 70, 74, 80, and 84 is that polytetrafluoroethylene exhibits a good dielectric strength that allows coatings 70, 74, 80, and 84 to be formed more thinly than would be possible using materials such as polyvinyl chloride. The use of materials such as polytetrafluoroethylene for insulating coatings 70, 74, 80, and 84 therefore allows the diameter of cable 12 to be minimized. By minimizing the diameter of cable 12, unsightly large cable diameters and undesirably stiff cable arrangements can be avoided.

Metallized conductive shield layer 52 may be formed over wires 42, 44, 48, and 50. Layer 52 may be formed from a tape having a width of about 8 mm to 1.2 cm (e.g., about 1.0 cm) that is wrapped in a spiral around cable 12. Strips of material of other widths (e.g., less than 8 mm or more than 1.2 cm) may also be used. If desired, layer 52 may be formed using arrangements other than spiral wrapping arrangements. For example, layer 52 may be formed from a sleeve of metallized plastic. An advantage of spiral wrapping arrangements is that these arrangements are compatible with readily-available tape wrapping cable manufacturing equipment. The wrapped thickness of the metallized plastic tape of shield 52 may be about 0.1 to 0.2 mm or any other suitable thickness (e.g., thicknesses of less than 0.1 mm or more than 0.2 mm). To ensure satisfactory electromagnetic shielding, the wrapped tape may cover all of the underlying core portion of cable 12 (i.e., the conductive tape may be wrapped with a 100% coverage level). If desired, other coverage levels may be used.

Conductive braided shield 58 may surround conductive shield 52. With one suitable arrangement, the metallized layer of shield 52 (i.e., conductive layer 56) may be formed on the outer surface of the conductive shield (i.e., on the radially outermost surface of backing layer 54), so that the inner surface of shield 58 and the outermost surface 52 are in electrical contact with each other. This helps to form a unitary conductive shield layer for reducing electromagnetic interference in cable 12. Shield layer 58 (and, if desired, shield layer 52) may be connected to the ground conductors in connector 14 and/or connector 16 (e.g., by soldering).

Magnetic layer 62 may be formed from a tube of magnetic material or from a spiral-wrapped magnetic tape. An advantage of a spiral wrapping arrangement for magnetic film 62 is that this type of arrangement is compatible with readily-available tape wrapping cable manufacturing equipment. The wrapped thickness of magnetic tape layer 62 may be about 0.1 to 0.2 mm (as an example). If layer 62 is formed from magnetic tape, the tape may have a width of about 8 mm to 1.2 cm (e.g., about 1.0 cm) or any other suitable width (e.g., a width less than 8 mm or a width greater than 1.2 cm).

To ensure satisfactory noise suppression, the wrapped magnetic tape may cover 100% of the underlying core portion of cable 12 (e.g., the magnetic tape may be wrapped with a 100% coverage level over the entire length of the cable). If desired, other schemes may be used. For example, the wrapped magnetic tape may be wrapped with a 100% coverage level for part of the cable length rather than the entire cable length.

Figure 4:
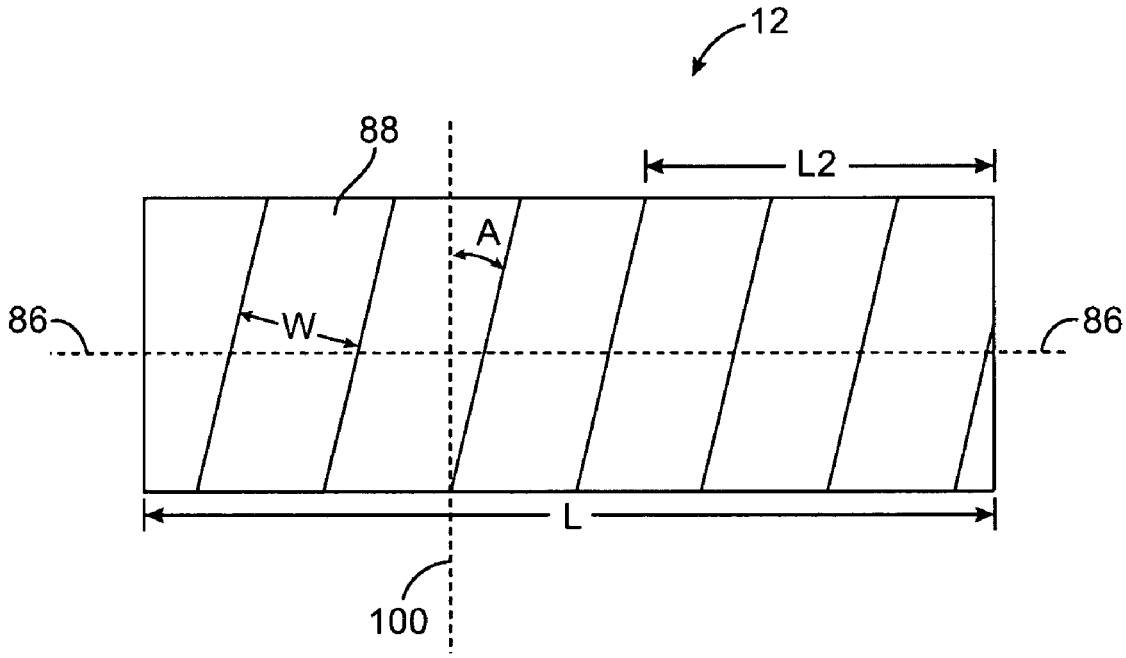
FIG. 4 is a side view of a cable showing an illustrative wrap pattern that may be used when wrapping magnetic noise suppression tape and metallized tape around the core of the cable in accordance with an embodiment of the present invention.

A side view of cable 12 showing an illustrative embodiment of a tape wrapping pattern that may be used in forming cable 12 is shown in FIG. 4. As shown in FIG. 4, tape 88 may be wrapped in a spiral around cable 12. Dotted line 86 represents the longitudinal axis of cable 12. The dotted line 100 represents a perpendicular to longitudinal axis 86. The angle (angle A) at which the tape is wrapped with respect to perpendicular line 100 may be any suitable angle (e.g., about 15°, about 10-20°, about 5-35°, less than 5°, more than 35°, etc.). With one illustrative embodiment, the spiral pattern of tape 88 establishes an angle of between 10° and 20° with respect to the perpendicular to longitudinal axis 86.

The illustrative spiral wrapping arrangement of FIG. 4 may be used for conductive shield 52 and/or magnetic layer 62. When forming conductive shield 52, tape 88 may be a tape of an aluminum-coated biaxially-oriented polyethylene terephthalate polyester film or other suitable metallized film. When forming magnetic film 62, tape 88 may be a tape of a high-permeability magnetic material such as the FLEX IMPEDOR magnetic material from NEC/TOKIN. An advantage of high-permeability magnetic materials such as FLEX IMPEDOR materials is that these materials suppress electromagnetic noise at frequencies in the hundreds of megahertz range and suppress electromagnetic noise at frequencies up to and exceeding frequencies in the gigahertz frequency range.

Because high-permeability magnetic materials such as these are able to suppress electromagnetic noise at frequencies in the upper megahertz and lower gigahertz ranges, they are particularly satisfactory for use with cables 12 that connect to electrical devices that generate signals with frequency components in the upper megahertz and lower gigahertz ranges and/or that have circuitry that operates at these frequencies. As an example, electrical equipment that includes cellular telephone circuitry may operate in the upper megahertz and lower gigahertz frequency ranges. Such equipment may produce potential noise at high frequencies and may be susceptible to excessive high-frequency noise in its high-frequency operating frequency bands. By using a cable such as cable 12 with an appropriate magnetic shielding layer 62, the level of high-frequency noise that is radiated from cable 12 may be suppressed and the level of high-frequency noise that is coupled by cable 12 into the electrical devices that are connected to cable 12 may be suppressed.

As shown in FIG. 4, wrapped tape 88 may cover the entire length of cable 12 (i.e., length L). If desired, wrapped tape 88 may cover only a portion of cable 12 such as length L2. The use of a full length noise suppression arrangement may be particularly advantageous in situations in which a thin cable is desired, because noise suppression capabilities may be spread along the entire cable using a relatively thin magnetic tape layer. In such arrangements, magnetic tape 62 and/or conductive shield 52 may be formed over all of length L, so that the entire cable core is wrapped with magnetic and/or conductive shielding. The wrapped magnetic and/or conductive shielding may extend under the strain relief portions of cable connectors 14 and 16. Maximum noise suppression may be achieved by ensuring that conductive shield 52 extends along the entire length L and that magnetic film 62 extends along the entire length L. Conductive shield 52 may be formed using a spiral tape wrapping process and magnetic film 62 may be formed using a spiral tape wrapping process. The wrapping angles used for wrapping the conductive shielding tape and the magnetic tape may be the same (e.g., angle A may be 15° when wrapping both the magnetic tape and the conductive tape) or may be different.

Figure 5:
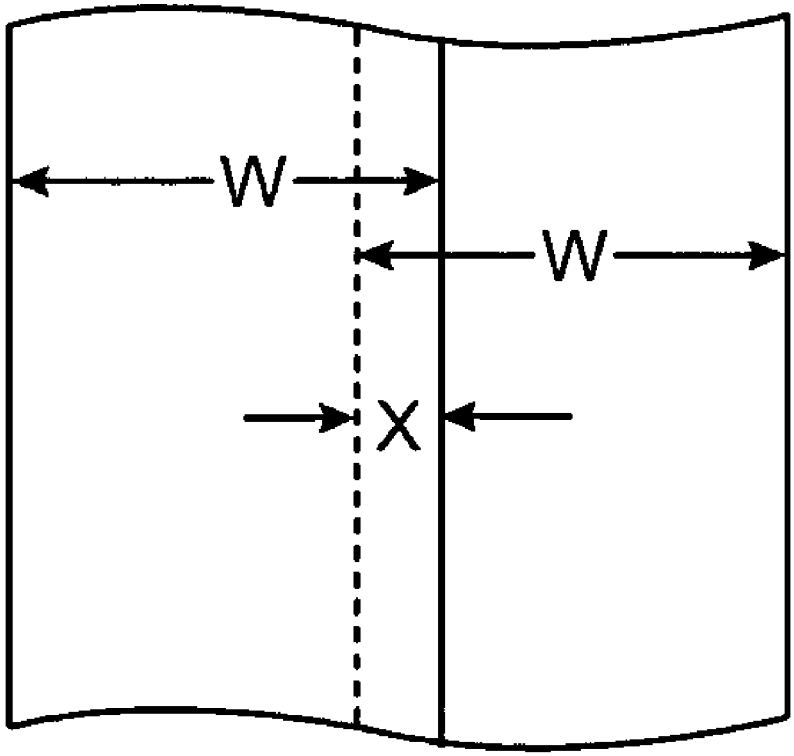
FIG. 5 is a top view of a portion of a spiral tape wrap showing how adjacent wraps of the tape may overlap one another in accordance with an embodiment of the present invention.

There is typically an overlap as each wrap of magnetic and/or conductive tape is applied to cable 12. As shown in FIG. 5, tape 88 (i.e., the magnetic tape and/or the conductive tape) may have width W. As tape 88 is wrapped around cable 12, each layer of tape 88 may overlap the next, leading to an overlap region having a width X. The amount of overlap between successive wraps of tape can be varied to accommodate any desired amount of coverage and layer thickness. For example, when it is desired to form a wrapped spiral of tape with less than 100% coverage, there is no overlap, but rather gaps between adjacent edges of tape 88. When it is desired to form a wrapped film with 100% coverage, the value of X is greater than or equal to zero. To prevent unintentional gaps in situations in which 100% coverage is desired, the value of X is typically greater than zero. Moreover, in arrangements in which a layer thickness of more than a single tape thickness is desired, the overlap X may be made relatively large.

In general, any suitable value of X may be used. For example, X may be 25% of W (25% overlap), X may be 50% of W (50% overlap, X may be 10-40% of W (10% to 40% overlap), X may be greater than 50% of W (greater than 50% coverage), or X may be less than 25% (less than 25% coverage). These are merely illustrative examples. Any suitable overlap value may be used when winding the magnetic tape and conductive tape around cable 12.

The amount of magnetic material that is formed on the magnetic tape may be adjusted to adjust the magnetic and physical properties of the tape.

Figure 6:
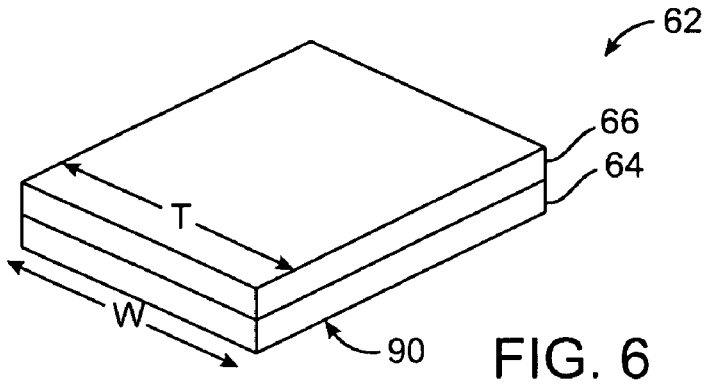
FIG. 6 is a perspective view of a high-permeability magnetic tape structure in which the magnetic material is formed in a strip of the same width as its backing film in accordance with an embodiment of the present invention.

As shown in FIG. 6, magnetic tape 88 may be formed so that width T of high-permeability magnetic material 66 and width W of backing layer 64 are the same. In this situation, the strip of magnetic material extends the full width of the backing layer and the tape.

Figure 7:
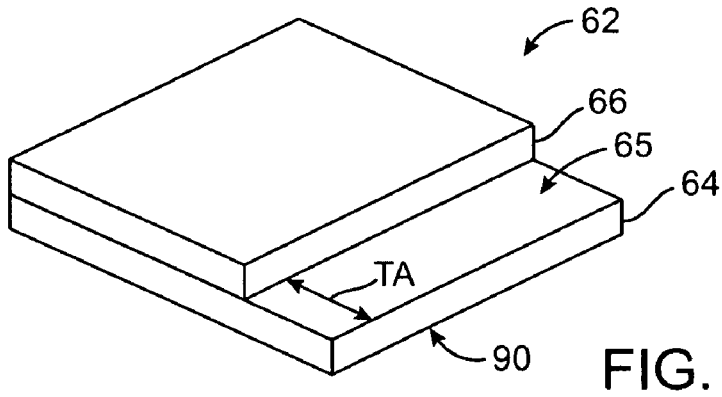
FIG. 7 is a perspective view of a high-permeability magnetic tape structure in which the magnetic material is formed in a strip that is narrower than its backing film and in which one edge of the magnetic material strip and the backing film are aligned in accordance with an embodiment of the present invention.

An alternative arrangement is shown in FIG. 7. With the FIG. 7 arrangement, the strip of magnetic material is narrower than the strip of backing material. In particular, magnetic material 66 has width T, whereas backing material 64 and tape 62 have width W. At one edge of the tape, the edge of the strip of dielectric backing is aligned with the edge of the strip of magnetic material. On the other edge, because the value of T is less than the value of W, there is an uncovered portion of backing film 64 of width TA (i.e., uncovered portion 65). The width TA may be any suitable size. As an example, the width TA may be 5% or more of W, less than 5% of W, 10% or more of W, 20% or more of W, 25% or more of W, etc.

Width TA of backing 64 in region 65 is not covered with magnetic material 66 and therefore generally exhibits a different amount of adhesion than the portion of backing 64 that has been coated with magnetic material. Depending on the type of backing material that is selected for backing 64, uncoated backing 64 may have more adhesion or less adhesion than coated backing 64. For a illustrative backing formed from polyester film such as a biaxially-oriented polyethylene terephthalate polyester film, the adhesion of the uncoated polyester film is generally greater than the adhesion of the coated polyester film. Films such as these in which the adhesion of the uncoated backing is sufficiently high may be sticky to the touch and may strongly adhere to other backing layer wraps. The uncoated portions of the films may also adhere to underlying portions of cable 12 (i.e., in situations in which the amount of overlap X is sufficiently small to expose at least part of uncoated width X to such underlying cable portions).

When wrapping partially coated tape 62 around cable 12, the additional adhesion provided by the uncoated portion 65 of the tape helps to secure the wrapped tape to the cable. When the cable is subsequently bent, the wrapped tape is less likely to slip. Uncoated portion 65 of backing 64 therefore helps to ensure that the cable performs as desired. Moreover, unsightly bulges that might otherwise develop due to tape slippage are avoided.

Figure 8:
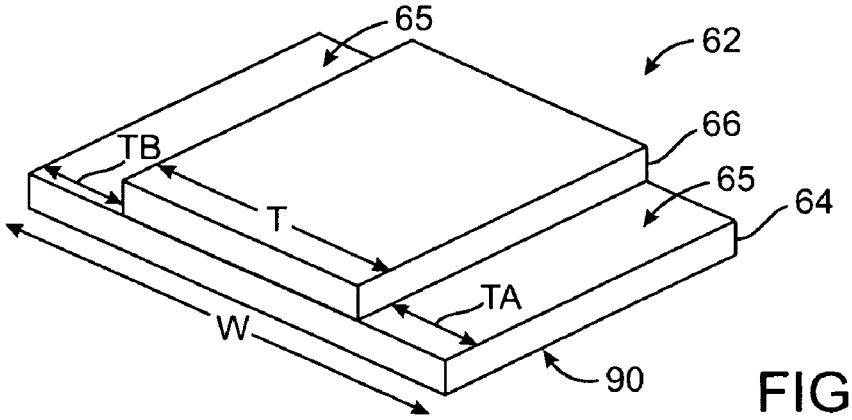
FIG. 8 is a perspective view of a high-permeability magnetic tape structure in which the magnetic material is formed in a strip of the same width as its backing film and in which the magnetic strip is approximately centered on the backing film in accordance with an embodiment of the present invention.

If desired, a portion of backing 64 may be exposed on either side of magnetic material 66, as shown in FIG. 8. In the example of FIG. 8, magnetic tape 62 has width W. Backing layer 64 also has width W. The width of the strip of magnetic film 66 is less than the width of backing strip 64. In particular, coating strip 66 has width T. Both edges of magnetic strip 66 are recessed with respect to the edges of backing 64. As a result, there are two exposed backing layer areas 65. The first portion of backing 64 that is not coated with magnetic material 66 has width TA. The second portion of backing 64 that is not coated with magnetic material 66 has width TB. Widths TA and TB may be equal or width TA may be larger or smaller than width TB. When magnetic material 66 is centered within backing 64, TA and TB are the same and the edges of the magnetic material strip are equidistant from the edges of the dielectric backing film. As with the arrangement of FIG. 7, uncoated portions 65 of tape 62 of FIG. 8 are generally sticky due to the intrinsic stickiness of the backing (e.g., the intrinsic tendency of biaxially-oriented polyethylene terephthalate polyester films to stick to themselves). This quality of the backing helps magnetic tape 62 stick to itself when wrapped about cable 12 and helps prevent magnetic tape 62 from forming bulges under the cable overmold.

If desired, an acrylic adhesive or other suitable adhesive may be applied to tape 62 to enhance adhesion. The adhesive may be applied to the entire surface of tape 62 or to selected portions such as those portions 65 of tape 62 that are not coated with magnetic material 66. Magnetic material 66 tends to be somewhat fragile and prone to peeling. It may therefore be advantageous, if adhesive is applied to tape 62, to apply the adhesive to surfaces of tape 62 that are uncoated with magnetic material. Examples of such surfaces include the exposed backing layer in the width TA of FIG. 7, the exposed backing layer in the widths TA and TB of FIG. 8, or the side of backing layer 64 that is completely uncoated with magnetic material 66 (i.e., surface 90 of FIGS. 6, 7, and 8, which lies on the opposite side of tape 62 from magnetic layer 66).

The foregoing is merely illustrative of the principles of this invention and various modifications can be made by those skilled in the art without departing from the scope and spirit of the invention.

What is claimed is:

1. A cable, comprising:

first and second connectors at respective ends of the cable that are configured to plug into electrical equipment;

signal wires that extend between the first connector and the second connector and that carry signals between the first connector and the second connector; and a noise-suppression magnetic film that surrounds the signal wires and that extends from the first connector to the second connector, wherein the magnetic film comprises a magnetic tape having a strip of ferrite loaded magnetic material formed on a strip of dielectric backing, wherein the strip of ferrite loaded magnetic material has a width, wherein the strip of dielectric backing has a width, and wherein the width of the strip of ferrite loaded magnetic material is less than the width of the strip of dielectric backing.

2. The cable defined in claim 1 further comprising a conductive shield that surrounds the signal wires and that extends from the first connector to the second connector.

3. The cable defined in claim 1 wherein at least one of the signal wires comprises a polytetrafluoroethylene coating.

4. The cable defined in claim 1 wherein the magnetic tape is wrapped around the signal wires in a spiral.

5. The cable defined in claim 1 wherein the dielectric backing comprises polyester.

6. A cable, comprising:

signal wires that carry signals;

a conductive shield that surrounds the signal wires;

a ferrite loaded magnetic tape that is wrapped in a spiral around the conductive shield, wherein the ferrite loaded magnetic tape comprises a strip of ferrite loaded magnetic material formed on a strip of dielectric backing, wherein the strip of ferrite loaded magnetic material has a width, wherein the strip of dielectric backing has a width, and wherein the width of the strip of ferrite loaded magnetic material is less than the width of the strip of dielectric backing.

7. The cable defined in claim 6 wherein the strip of dielectric backing has a first edge and a second edge, wherein the strip of ferrite loaded magnetic material has a first edge and a second edge, wherein there is an uncoated backing layer surface between the first edge of the strip of ferrite loaded magnetic material and the first edge of the strip of dielectric backing that is uncoated by the ferrite loaded magnetic material, and wherein the second edge of the strip of ferrite loaded magnetic material and the second edge of the strip of dielectric backing are aligned.

8. The cable defined in claim 6 wherein the strip of dielectric backing has a first edge and a second edge, wherein the strip of ferrite loaded magnetic material has a first edge and a second edge, wherein there is an uncoated backing layer surface between the first edge of the strip of ferrite loaded magnetic material and the first edge of the strip of dielectric backing that is uncoated by the ferrite loaded magnetic material, wherein there is an uncoated backing layer surface between the second edge of the strip of ferrite loaded magnetic material and the second edge of the strip of dielectric backing that is uncoated by the ferrite loaded magnetic material, and wherein the uncoated backing layer surface between the first edge of the strip of ferrite loaded magnetic material and the first edge of the strip of dielectric backing and the uncoated backing layer surface between the second edge of the strip of ferrite loaded magnetic material and the second edge of the strip of dielectric backing have equal widths.

9. The cable defined in claim 6 wherein the signal wires comprise two data wires and two power wires, wherein the signal wires include copper cores coated with polytetrafluoroethylene coating, wherein the copper cores of the data wires and the copper cores of the power wires have respective diameters, and wherein the diameters of the copper cores of the data wires are less than the diameters of the copper cores of the power wires.

10. The cable defined in claim 6 further comprising a strengthening cord.

11. A cable comprising:

a strengthening cord of polyaramid polyparaphenylene terephthalamide;

two data wires each having a conductive core and an insulating coating of polytetrafluoroethylene and two power wires each having a conductive core and an insulating coating of polytetrafluoroethylene, wherein the conductive cores of the data wires have smaller diameters than the conductive cores of the power wires and wherein the insulating coating of the data wires is thicker than the insulating coating of the power wires;

a first conductive shield formed from aluminized biaxially-oriented polyethylene terephthalate polyester film that is wrapped around the strengthening cord, the two data wires, and the two power wires in a spiral;

a second conductive shield that surrounds the first conductive shield, wherein the second conductive shield comprises braided metal;

a magnetic tape that is wrapped around the strengthening cord, the two data wires, the two power wires, the first conductive shield, and the second conductive shield in a spiral, wherein the cable has a longitudinal axis and wherein the magnetic tape is wrapped in a spiral pattern establishing an angle of between 10° and 20° with respect to a perpendicular to the longitudinal axis, wherein the magnetic tape comprises a strip of ferrite loaded magnetic material formed on a strip of dielectric backing, wherein the strip of ferrite loaded magnetic material has a width, wherein the strip of dielectric backing has a width, and wherein the width of the strip of ferrite loaded magnetic material is less than the width of the strip of dielectric backing; and an insulating coating that surrounds the spirally-wrapped magnetic tape.

12. The cable defined in claim 11 wherein the strip of ferrite loaded magnetic material has a width of about 8 mm to 1.2 cm.

13. The cable defined in claim 11 wherein the strip of dielectric backing has a first edge and a second edge, wherein the strip of magnetic material has a first edge and a second edge, wherein there is an uncoated backing layer surface between the first edge of the strip of magnetic material and the first edge of the strip of dielectric backing that is uncoated by the magnetic material, and wherein the second edge of the strip of magnetic material and the second edge of the strip of dielectric backing are aligned.

14. The cable defined in claim 11 wherein the strip of dielectric backing has a first edge and a second edge, wherein the strip of magnetic material has a first edge and a second edge, wherein there is an uncoated backing layer surface between the first edge of the strip of magnetic material and the first edge of the strip of dielectric backing that is uncoated by the magnetic material, and wherein there is an uncoated backing layer surface between the second edge of the strip of magnetic material and the second edge of the strip of dielectric backing that is uncoated by the magnetic material.

15. The cable defined in claim 11 wherein the wrapped magnetic tape has a wrapped thickness of about 0.1 to 0.2 mm and overlaps itself by at least 25%.

16. A cable, comprising:

first and second connectors at respective ends of the cable that are configured to plug into electrical equipment, wherein each connector has a plurality of pins, a polycarbonate overmold, and a strain relief portion;

signal wires that extend between the pins of the first connector and the pins of the second connector and that carry signals between the first connector and the second connector; and a tape of noise-suppression magnetic film that is wrapped around the signal wires in a spiral from the first connector to the second connector extending under the strain relief portions, wherein the magnetic film comprises a strip of magnetic material formed on a strip of dielectric backing, wherein the strip of magnetic material and the strip of dielectric backing each have a width, and wherein the width of the strip of magnetic material is less than the width of the strip of dielectric backing.

17. The cable defined in claim 16 further comprising:

a first conductive shield formed from metallized dielectric tape that is wrapped around the signal wires in a spiral; and a second conductive shield that surrounds the first conductive shield, wherein the second conductive shield comprises braided metal of at least 85% coverage.

18. The cable defined in claim 16 further comprising:

a first conductive shield formed from metallized dielectric tape that is wrapped around the signal wires in a spiral;

power wires that extend between the pins of the first connector and the pins of the second connector and that carry power between the first connector and the second connector; and a second conductive shield that surrounds the first conductive shield, wherein the second conductive shield comprises braided metal of at least 85% coverage, wherein the power wires have insulating coatings, wherein the signal wires have insulating coatings that are thicker than the insulating coatings of the power wires, and wherein at least one of the insulating coatings comprises a polytetrafluoroethylene coating.

19. The cable defined in claim 16 wherein the magnetic film is wrapped to a thickness of between 0.1 and 0.2 millimeters, wherein the cable further comprises a strengthening cord of polyaramid polyparaphenylene terephthalamide, and wherein the signal wires comprise at least one twisted pair.

* * * * *